US008938887B2

(12) United States Patent
Brüning et al.

(10) Patent No.: US 8,938,887 B2
(45) Date of Patent: Jan. 27, 2015

(54) CONDITIONING DEVICE AND METHOD FOR DRYING AND CONTROLLING THE TEMPERATURE OF A BALLAST BED

(75) Inventors: Dirk Brüning, Leverkusen (DE); Udo Maier, Pulheim (DE)

(73) Assignee: Bayer Intellectual Property GmbH, Monheim (DE)

( * ) Notice: Subject to any disclaimer, the term of this patent is extended or adjusted under 35 U.S.C. 154(b) by 267 days.

(21) Appl. No.: 13/695,447

(22) PCT Filed: Apr. 26, 2011

(86) PCT No.: PCT/EP2011/056592
§ 371 (c)(1),
(2), (4) Date: Nov. 19, 2012

(87) PCT Pub. No.: WO2011/134967
PCT Pub. Date: Nov. 3, 2011

(65) Prior Publication Data

US 2013/0055586 A1 Mar. 7, 2013

(30) Foreign Application Priority Data

Apr. 30, 2010 (DE) ..... 10 2010 016 733

(51) Int. Cl.
*F26B 7/00* (2006.01)
*E01B 1/00* (2006.01)
*E01B 27/06* (2006.01)

(52) U.S. Cl.
CPC ..... *E01B 1/001* (2013.01); *E01B 27/06* (2013.01)
USPC ..... 34/67; 34/72; 34/79; 34/84; 291/3; 291/38; 329/654

(58) Field of Classification Search
USPC ..... 34/67, 72, 79, 84, 104, 105; 291/3, 13, 291/38; 239/654
See application file for complete search history.

(56) References Cited

U.S. PATENT DOCUMENTS 1,358,844 A * 11/1920 Hartman ..... 105/37
1,407,375 A * 2/1922 Burbank ..... 405/7
(Continued)

FOREIGN PATENT DOCUMENTS

CN 101663437 A 4/2008
DE 10147199 A1 * 4/2003 ..... B05D 3/04
(Continued)

OTHER PUBLICATIONS

International Search Report for PCT/EP2011/056592 mailed Sep. 2, 2011.

*Primary Examiner* — Steve M Gravini
(74) *Attorney, Agent, or Firm* — Drinker Biddle & Reath LLP

(57) ABSTRACT

Conditioning device (24) and method for drying and/or controlling the temperature of a ballast bed (12) of a railway track system (10), wherein the railway track system (10) has sleepers (14) resting on the ballast bed (12) and rails (16) resting on the sleepers, wherein the conditioning device has a bogie (30) for moving the conditioning device (24). An outlet nozzle (36) for blowing temperature-controlled air into the ballast bed (12) via at least one blowing-in region (26) positioned between two adjacent sleepers (14) is connected to the bogie (30), as is at least one cover plate (42) for essentially air-tight coverage of an upper side, pointing essentially in the direction counter to the direction of gravity, of a side strip (20), provided next to the sleepers (14) in the direction of travel, of the ballast bed (12). In a method for drying and controlling the temperature of a ballast bed (12) of a railway track system (10), an upper side of the ballast bed (12) and/or at least one sleeper (14) and at least one rail (16) are sealed in an essentially air-tight fashion outside a blowing-in region (26) before temperature-controlled air is blown into the ballast bed (12) via the blowing-in region (26).

10 Claims, 5 Drawing Sheets

(56) References Cited

U.S. PATENT DOCUMENTS

Figure 1:
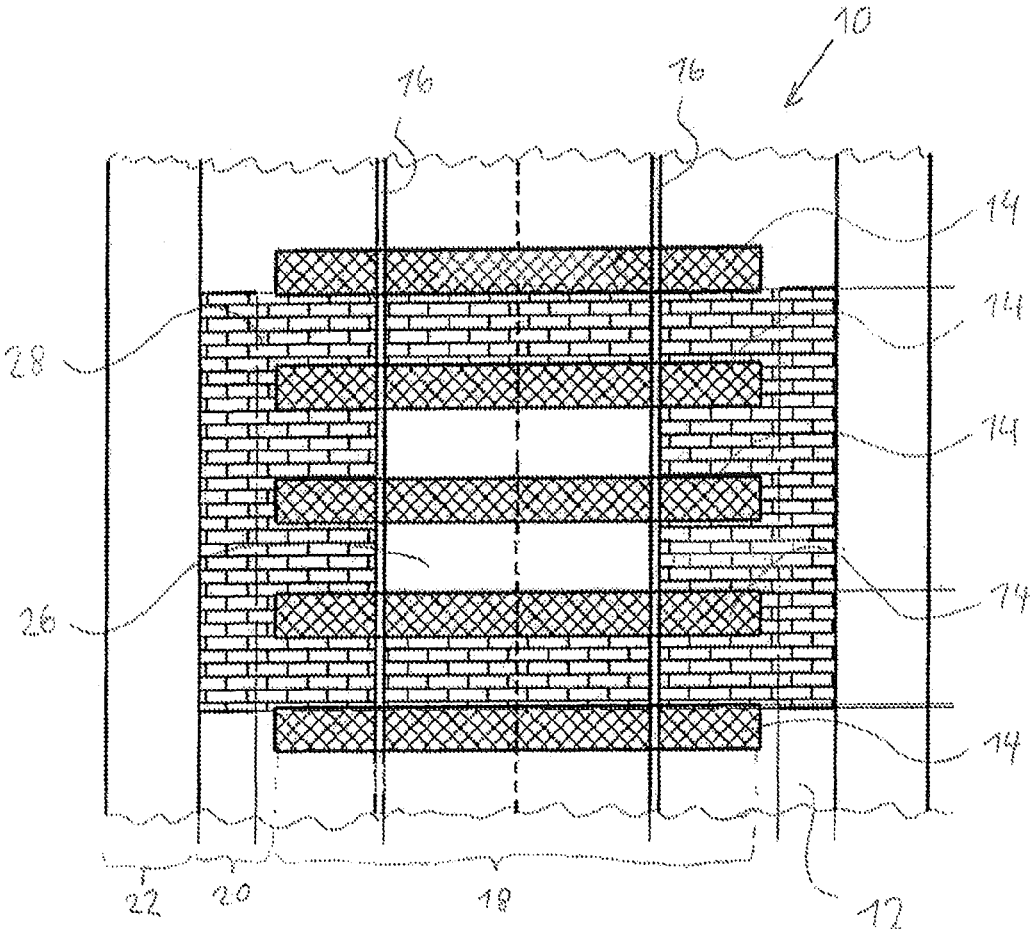

| | | | | |
|---|---|---|---|---|
| 1,596,072 | A * | 8/1926 | Anderberg | 122/465 |
| 2,392,081 | A * | 1/1946 | Crandall | 405/2 |
| 3,271,060 | A * | 9/1966 | Kilgore et al. | 291/3 |
| 3,345,097 | A * | 10/1967 | Smith | 291/3 |
| 4,571,849 | A * | 2/1986 | Gardner et al. | 34/79 |
| 8,500,177 | B2 * | 8/2013 | Bartling | 291/25 |
| 2002/0157274 | A1 * | 10/2002 | Rydzewski et al. | 34/79 |
| 2008/0173724 | A1 | 7/2008 | Frenzel | |
| 2009/0152368 | A1 | 6/2009 | Frenzel | |
| 2009/0172968 | A1 * | 7/2009 | Hensley | 34/467 |
| 2010/0140367 | A1 | 6/2010 | Pawlik et al. | |
| 2014/0013615 | A1 * | 1/2014 | Miedema et al. | 34/487 |

FOREIGN PATENT DOCUMENTS

| | | | |
|---|---|---|---|
| DE | 102007057064 | A1 | 11/2007 |
| EP | 1619305 | B1 | 5/2009 |
| JP | 200534447 | A | 8/2006 |
| SU | 1504299 | * | 8/1989 |
| WO | WO-2007090901 | A3 | 11/2007 |
| WO | WO-2008128665 | A1 | 10/2008 |
| WO | WO-2009068169 | A1 | 6/2009 |
| WO | WO 2011134967 | A1 * | 11/2011 |

* cited by examiner

CONDITIONING DEVICE AND METHOD FOR DRYING AND CONTROLLING THE TEMPERATURE OF A BALLAST BED

PRIORITY

Priority is claimed as a national stage application, under 35 U.S.C. §371, to PCT/EP2011/056592, filed Apr. 26, 2011, which claims priority to German Application No. 10 2010 016 733.9, filed Apr. 30, 2010. The disclosures of the aforementioned priority applications are incorporated herein by reference in their entirety.

The invention relates to a conditioning device and to a method for drying and/or controlling the temperature of a ballast bed, by means of which the track bed of a railway track system can be dried and the temperature controlled in order subsequently to be able to foam the ballast bed at least in part.

In order to stabilize the track bed of a railway track system and to be able to remove heavier loads, it is known to foam out the cavities of a ballast bed of a railway track system with polyurethane (PU). To this end, the starting materials isocyanate and polyol are injected into the cavities of the ballast bed where they react to form polyurethane foam. In order to achieve a defined reaction, it is necessary to set up the corresponding reaction conditions inside the ballast bed in a defined manner. In particular, the ballast bed is to be as dry as possible and free of water. For example, EP 1 619 305 B1 makes known lowering a heating bell onto the tracks prior to foaming out the ballast bed and drying the ballast bed with hot air. Said measure has proved to be non-effective in practice, in particular if the railway track system has been exposed beforehand to a shower of rain. Comparable proposals are known from WO 2009/068169 A1, WO 2008/128665 A1 and US 2008/0173724 A1.

It is the object of the invention to create a conditioning device for drying and controlling the temperature of a ballast bed as well as a method for drying and controlling the temperature of a ballast bed, by means of which intended reaction conditions inside the ballast bed, in particular with regard to moisture content, can be set up.

The object is achieved by a conditioning device with the features of claim 1 and by a method with the features of claim 10. Preferred developments of the invention are provided in the sub-claims.

The conditioning device as claimed in the invention for drying and/or controlling the temperature of a ballast bed of a railway track system, wherein the railway track system has sleepers resting on the ballast bed and rails resting on the sleepers, has a bogie for moving the conditioning device, in particular on the rails. An outlet nozzle for blowing temperature-controlled air into the ballast bed via at least one blowing-in region positioned between two adjacent sleepers is connected to the bogie. As claimed in the invention, at least one cover plate is connected to the bogie for the substantially air-tight covering of a top surface of a side strip of the ballast bed, said top surface pointing substantially in opposition to the direction of gravity and said side strip being provided next to the sleepers in the direction of travel.

The conditioning device controls not only the blowing-in of the temperature-controlled air, but also the escaping of temperature-controlled air out of the ballast bed. The cover plate prevents the temperature-controlled air, shortly after penetrating into the ballast bed, being able to escape again directly next to the blowing-in region via the side strips of the ballast bed. By means of the at least one cover plate, the ballast bed can seal the ballast bed in particular running around the blowing-in region and can prevent a corresponding short circuit current. The cover plate provides a flow resistance in the region of the top surface of the ballast bed which is so high that the temperature-controlled air has to flow at least as far as up to the slope surfaces of the ballast bed which fall away in an inclined manner in order to be able to escape from the side of the ballast bed. This leads to the temperature-controlled air penetrating comparatively deeply into the ballast bed before the temperature-controlled air is able to leave the ballast bed. This makes it possible to dry the ballast bed as far as up to a ground surface or to a drainage mat arranged between the ballast bed and the ground surface and to set up a defined temperature, preferably a temperature of between 20° C. and 50° C. In this connection, it is taken into account in particular that the side strip of the ballast bed has a defined minimum width, so that compressive forces arising are able to be directed away in a reliable manner and the tracks of the railway track system retain their position. The cover plate, in its extent pointing transversely with respect to the direction of travel, can consequently correspond substantially to said minimum width of the side strip. The substantially air-tight covering of the side strip in the region of the minimum width of the side strip suffices substantially so that the temperature-controlled air is able to penetrate into the ballast bed by approximately 350 mm. Said depth of penetration, as a rule, is sufficient in order to penetrate the entire ballast bed with temperature-controlled air.

The blowing-in region can include, in particular, a sleeper compartment realized between two adjacent sleepers. The blowing-in region preferably includes two sleeper compartments which are adjacent each other. The blowing-in region can be defined in particular at the side by the rails. As a result, the outlet nozzle can be lowered as far as to the top surface of the sleepers in order to blow in the temperature-controlled air. The outlet nozzle can be realized as a simple tube end and can have, for example, a substantially rectangular cross section which corresponds in a substantial manner to the blowing-in region. The outlet nozzle can also be realized as a lance which, in particular, can dip into the ballast bed. The blowing-in region, and where applicable the region surrounding the blowing-in region, can be covered by the conditioning device in a substantially air-tight manner in relation to the surrounding area such that the blown-in, temperature-controlled air collects inside the conditioning device and there can build up a correspondingly high pressure in order to avoid the temperature-controlled air escaping again in the region of the conditioning device. In particular, at least one sealing-off device for the substantially air-tight sealing of a sleeper and/or of a rail and/or of a top surface of a supporting strip of the ballast bed is connected to the bogie, said top surface pointing in opposition to the direction of gravity and said supporting strip being provided in front of or behind the sleeper in the direction of travel. The cover plate can prevent the temperature-controlled air from escaping from the side, whilst the sealing-off device can prevent the temperature-controlled air from escaping in front of and behind the blowing-in region. In this connection, use is made of the fact that the sleeper itself provides an air-tight sealing of the ballast bed such that it is sufficient to seal the conditioning device in a substantially air-tight manner at the sleeper and where applicable at the rail connected to the sleeper. As an addition or as an alternative, a sleeper compartment can also be covered in a planar manner and in a substantially air-tight manner by the sealing-off device in a comparable manner to the cover plate.

The sealing-off device is preferably designed in such a manner that the sealing-off device seals in a substantially air-tight manner at a sleeper which is spaced apart from a sleeper which borders the blowing-in region, wherein the sealing-off device seals in particular at a side surface of the sleeper which points in the direction of travel or in opposition to the direction of travel. In particular in the case of a cleared-out sleeper compartment, on one side of a sleeper pointing in the direction of travel or in opposition to the direction of travel, there is a substantially planar surface which makes a substantially air-tight sealing possible in a particularly simple manner. To this end, it is in particular not one of the sleepers which define the blowing-in region that is used, but a sleeper which is preferably arranged one sleeper compartment further on. This makes it possible, by means of the conditioning device, to pre-heat the sleeper compartment arranged in front of the blowing-in region in the direction of travel, and to vaporize part of the water located next to the blowing-in region in the ballast bed. In particular, the pressure of the temperature-controlled air prevailing inside the conditioning device can be sufficient to prevent the temperature-controlled air escaping in the region of the sleeper compartment at a spacing from the blowing-in region. This makes a correspondingly high flow resistance possible on the top surface of the ballast bed in a comparatively large region, said flow resistance leading to a particularly large depth of penetration of the temperature-controlled air into the ballast bed.

In a particularly preferred manner, the sealing-off device has at least one sealing-off plate which is movable transversely with respect to the direction of travel for the lateral, substantially air-tight sealing of the rail and/or of the cover plate. This makes it possible to lower the sealing-off device in a substantially vertical manner past the tracks and then, by means of a substantially horizontal movement of the sealing-off plate, to achieve a lateral sealing to the rail or to the cover plate. This makes substantially air-tight sealing possible even in the case where undercuts which are to be sealed occur, such as, for example, in the case of a rail designed as a double T bearer. This makes a sealing by the conditioning device with the surrounding area possible in a particularly simple manner, preferably running around the blowing-in region at a spacing, it being possible for the sealing to be effected both on horizontal surfaces and/or vertical surfaces and/or surfaces which extend in an inclined or undercut manner.

In particular, a hood which is connected to the bogie is provided, wherein the hood is connected in particular in a substantially air-tight manner to the cover plate and/or to the sealing-off device. The hood can prevent temperature-controlled air from escaping via an upper region of the conditioning device. This makes it possible to set up an elevated pressure level under the hood inside the conditioning device by means of the temperature-controlled air brought in via the outlet nozzle, said pressure level preventing temperature-controlled air escaping from the ballast bed back into the conditioning device. This can prevent short circuit flows. The hood has, in particular, one opening for the outlet nozzle. The hood, the cover plate and the sealing-off device can realize a closed bell which is interrupted simply by the outlet nozzle, it being possible to seal off said bell in an air-tight manner substantially totally with respect to the surrounding area. As a result, unused out-flow of the temperature-controlled air out of the conditioning device can be avoided. Instead of this, the temperature-controlled air can only leave the conditioning device via the ballast bed and, as a result, can control the temperature of the ballast bed to an intended temperature and can remove moisture, in particular water, from the ballast bed.

Preferably, for the substantially air-tight sealing, the cover plate and/or the sealing-off device and/or the hood is provided with a form-flexible sealing material, wherein the sealing material has in particular an air cushion and/or brushes and/or rubber-like coatings and/or foam material, wherein the sealing material is covered in particular by an abrasion-resistant film and/or textile. The form-flexible development of the sealing material can automatically balance out irregularities in the surface to be sealed, in particular the top surface of the ballast bed. The abrasion-resistant film, for example a rubber film, can prevent the ballast stones from abrading the sealing material. By the sealing material being able to penetrate into indentations and undercuts even if the surface is irregular, non-precise alignments can be balanced out and as planar and cavity-free a covering as possible can be achieved. In particular, a pressure difference between the pressure inside the conditioning device and the surrounding area of, for example, 40 mbar can be sealed securely with only slight leakage losses.

In a preferred embodiment, at least two outlet nozzles are provided for blowing temperature-controlled air into the ballast bed via at least two blowing-in regions which are spaced apart with respect to each other, wherein the two blowing-in regions are preferably separated from each other in a substantially air-tight manner by means of a separating device, which is connected to the bogie and is developed in particular in a comparable manner to the sealing-off device. The volume flow of temperature-controlled air can be correspondingly increased by means of the at least two outlet nozzles. In particular, a volume flow of 10,000 $m^3/h$ can be blown-in. The two blowing-in regions make it possible to dry the ballast bed and to control the temperature at the same time in parallel at two different positions without the blown-in, temperature-controlled air of the one blowing-in region being able to disturb the blown-in, temperature-controlled air of the other blowing-in region. This makes it possible, for example, first of all to act upon the two blowing-in regions with temperature-controlled air and then, by means of the bogie, to move the conditioning device in such a manner that the blowing-in regions previously not acted upon are supplied with temperature-controlled air. This can accelerate the controlling of the temperature and the drying of the ballast bed. In particular, when the two outlet nozzles are separated from each other in an air-tight manner by means of the separating device, it is possible to act upon the respective blowing-in region with different temperatures. For example, in the front region in the direction of travel, the ballast bed can be dried in a substantially complete manner at a particularly high temperature before the temperature of said region of the ballast bed is controlled to a desired, somewhat lower temperature with the rear outlet nozzle in the direction of travel.

The outlet nozzle is preferably developed in such a manner that the blowing-in region includes at least two sleeper compartments arranged between two sleepers. This makes it possible to act upon two sleeper compartments at the same time with temperature-controlled air. In particular, after a first conditioning operation the conditioning device can be moved on further by means of the bogie by the distance of one sleeper compartment such that in a second conditioning operation, the blowing-in region includes a sleeper compartment of the previous blowing-in region and a sleeper compartment which has not yet been acted upon with temperature-controlled air. This makes it possible to pre-heat the new sleeper compartment initially and preferably to dry it in a substantially complete manner and then in the following conditioning operation to set up the desired end temperature. This means that it is possible to consider that depending on the moisture content of the ballast bed a corresponding amount of vaporization heat is required to dry the ballast bed such that in the case of a particularly moist ballast bed, the desired end temperature inside the ballast bed cannot forcibly be set up with only one conditioning operation.

In particular, the cover plate is connected to the bogie so as to be pivotable between an operating position and a conveying position, wherein the extent of the conditioning device in the conveying position of the cover plate for conveying in a railway car is smaller than in the operating position of the cover plate. When the cover plate is in the conveying position, the conditioning device can be put into a conveying car, for example, by means of a crane without the cover plate being able to abut against the walls of the conveying car. In the operating position of the cover plate, the cover plate can clearly extend to the side beyond the usual dimensions of a conveying car so that a particularly large surface of the side strip of the ballast bed can be covered in an air-tight manner. The cover plate, where necessary, can be locked in the conveying position, for example by means of locking pins so that the cover plate does not inadvertently move out of the conveying position when being conveyed.

The invention also relates to a method for drying and controlling the temperature of a ballast bed of a railway track system, wherein the railway track system has sleepers resting on the ballast bed and rails resting on the sleepers, where in particular by means of a conditioning device, which can be developed and further developed as described above, a top surface of the ballast bed and/or at least one sleeper and/or at least one rail is sealed in a substantially air-tight manner outside a blowing-in region before air, which is temperature-controlled, is blown into the ballast bed via the blowing-in region. By sealing off the region of the surrounding area surrounding the blowing-in region, short circuit currents can be avoided such that the temperature-controlled air is able to penetrate particularly deeply into the ballast bed in order to dry the ballast bed and to control its temperature to a desired end temperature. The method can be designed and further designed, in particular as explained above by way of the conditioning device.

It is possible, in particular, to position two or more conditioning devices one behind the other on the same railway track system, the different conditioning devices each controlling the temperature of regions of the ballast bed which are not controlled in each case by the other conditioning device. This makes it possible in a comparatively short time to control the temperature of a correspondingly large section of the railway track system. The temperature-controlled regions of the ballast bed can then be foamed out with polyurethane, in particular the load cone produced under the sleepers being foamed out. In addition, non-foamed regions of the ballast bed can be bonded to the surface or be fixed with an, in particular, porous foam, preferably of polyurethane. This prevents stones from escaping from the ballast and flying everywhere. The foaming below the sleepers is effected in particular in such a manner that rain water can be drained away between the foamed regions. In a particularly preferred manner, at least one residual region which extends from the surface as far as to the ground surface or to a drainage mat resting on the ground surface remains between two sleepers such that rain water is able to be drained away in a reliable manner. In order to move the conditioning device, it is preferably provided to raise up the hood and/or the cover plate and/or the sealing-off device, for example in a hydraulic or pneumatic manner a little, and to move the conditioning device with the bogie along the rails of the railway track system. The raised regions can subsequently be lowered again in order to obtain an air-tight covering. In particular, the conditioning device can press at least in part with its own weight on the cover plate and/or the sealing-off device in order to provide a correspondingly high pressing force for the substantially air-tight sealing. To this end, for example, the hood and the parts connected to the hood can be lowered in relation to the rails or in relation to running wheels of the bogie resting on the rails in a preferably hydraulic or pneumatic or electric manner, for example by means of a lifting spindle drive. An unintended offset in the direction of travel or in opposition to the direction of travel of the sealing-off device in relation to a sleeper can be balanced out in particular by means of a displacement of the sealing-off device in the direction of travel or in opposition to the direction of travel, preferably by means of a pneumatic or hydraulic actuating system.

Figure 2:
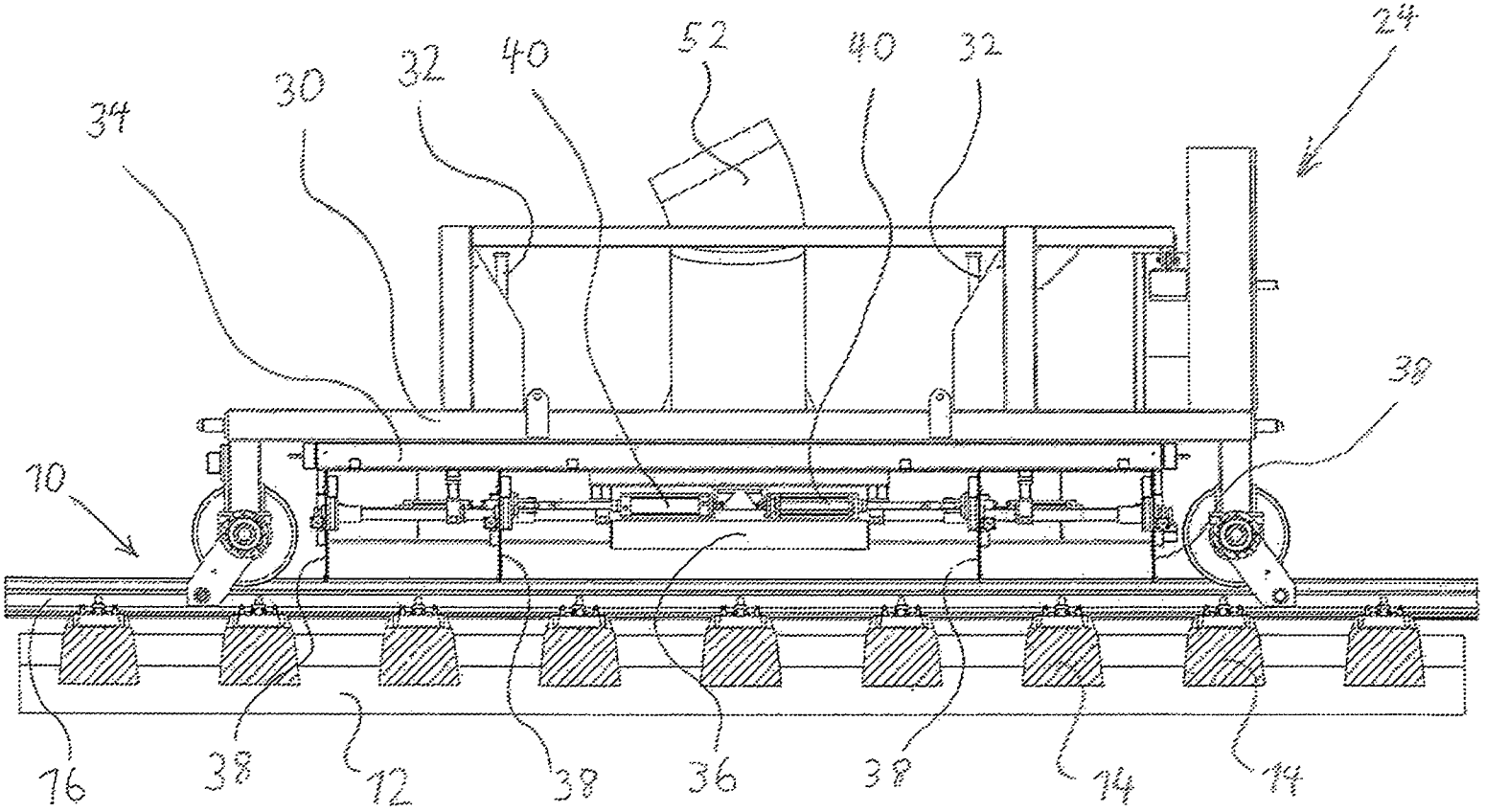
Figure 3:
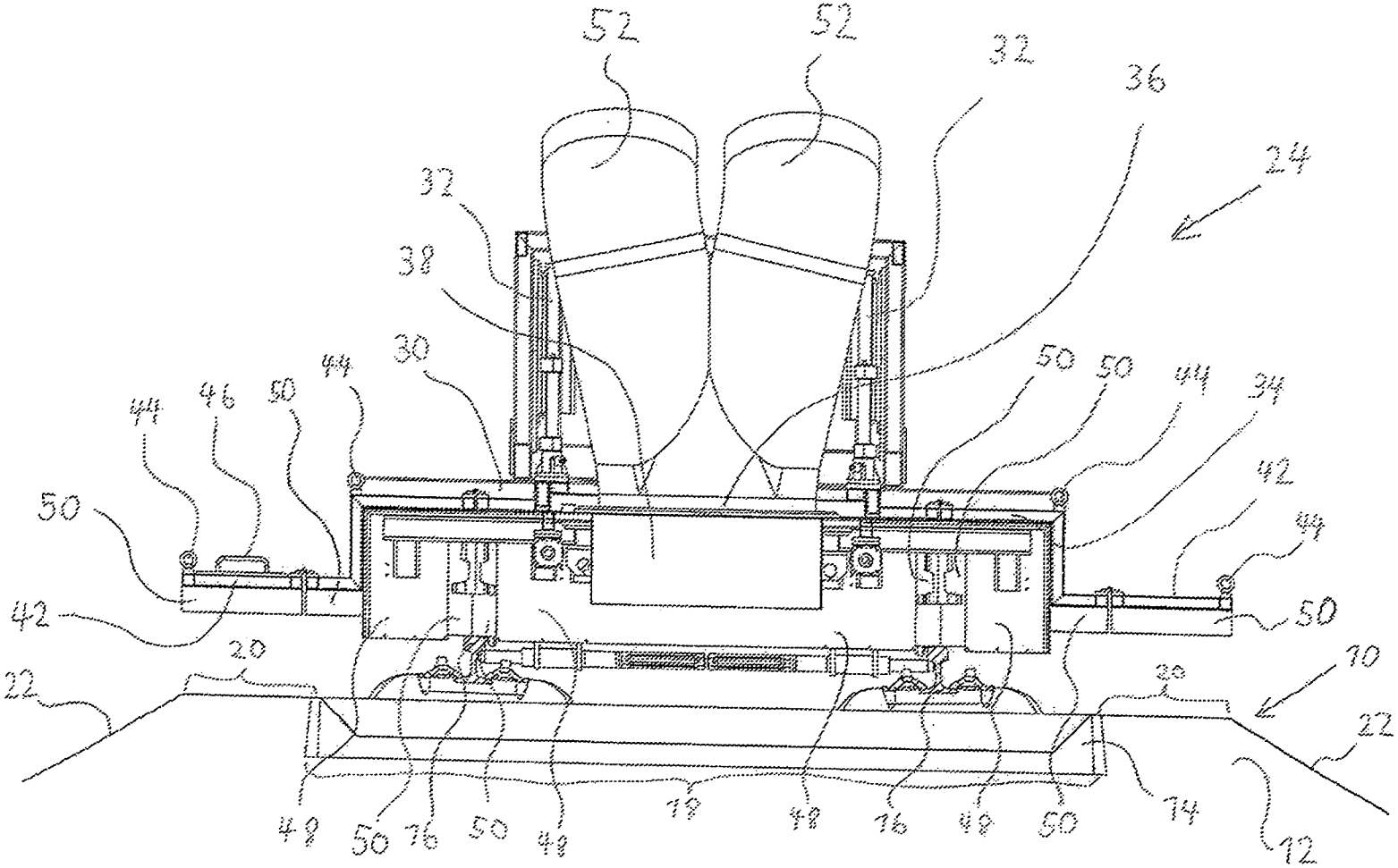
Figure 4:
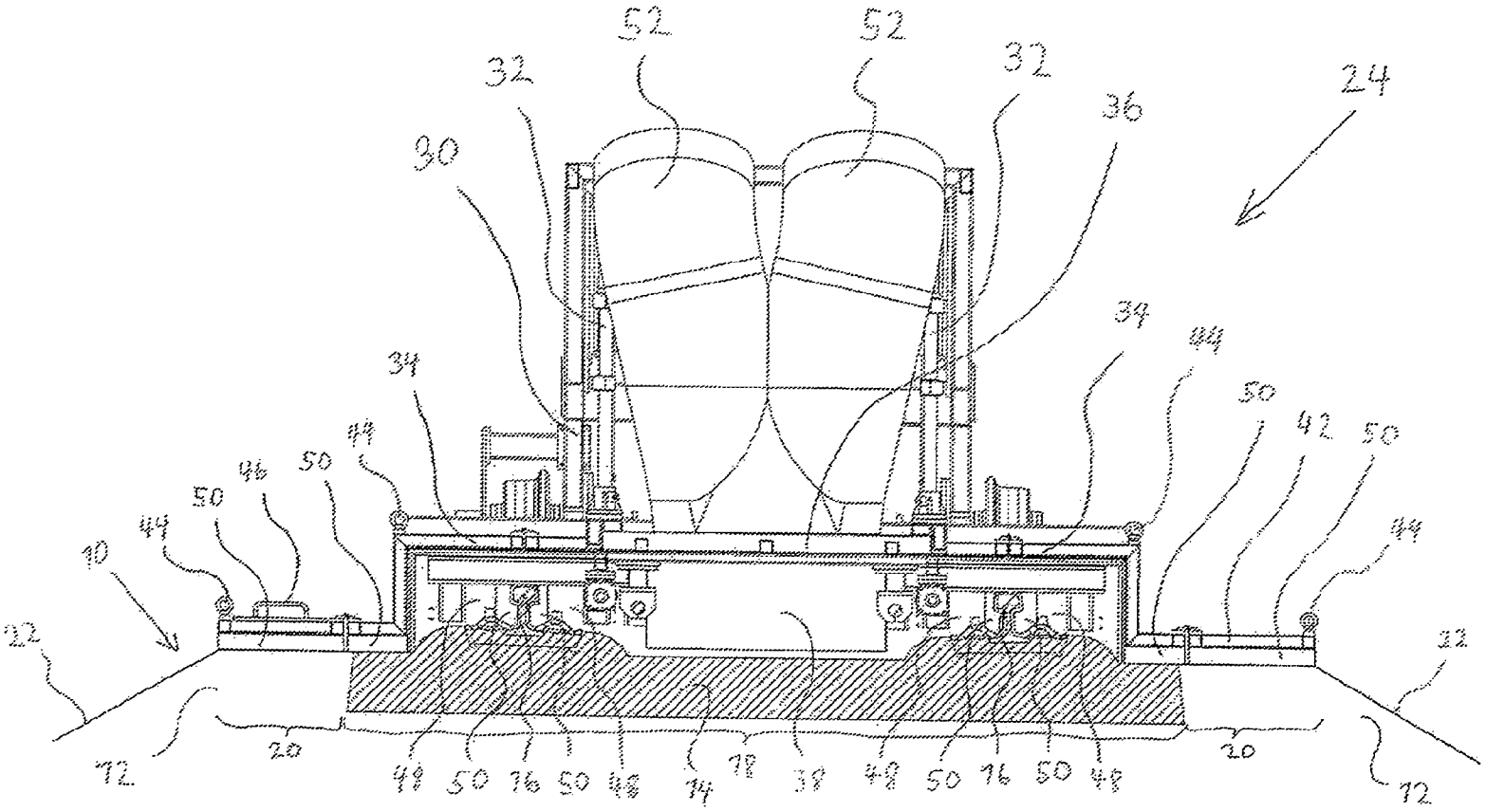
Figure 5:
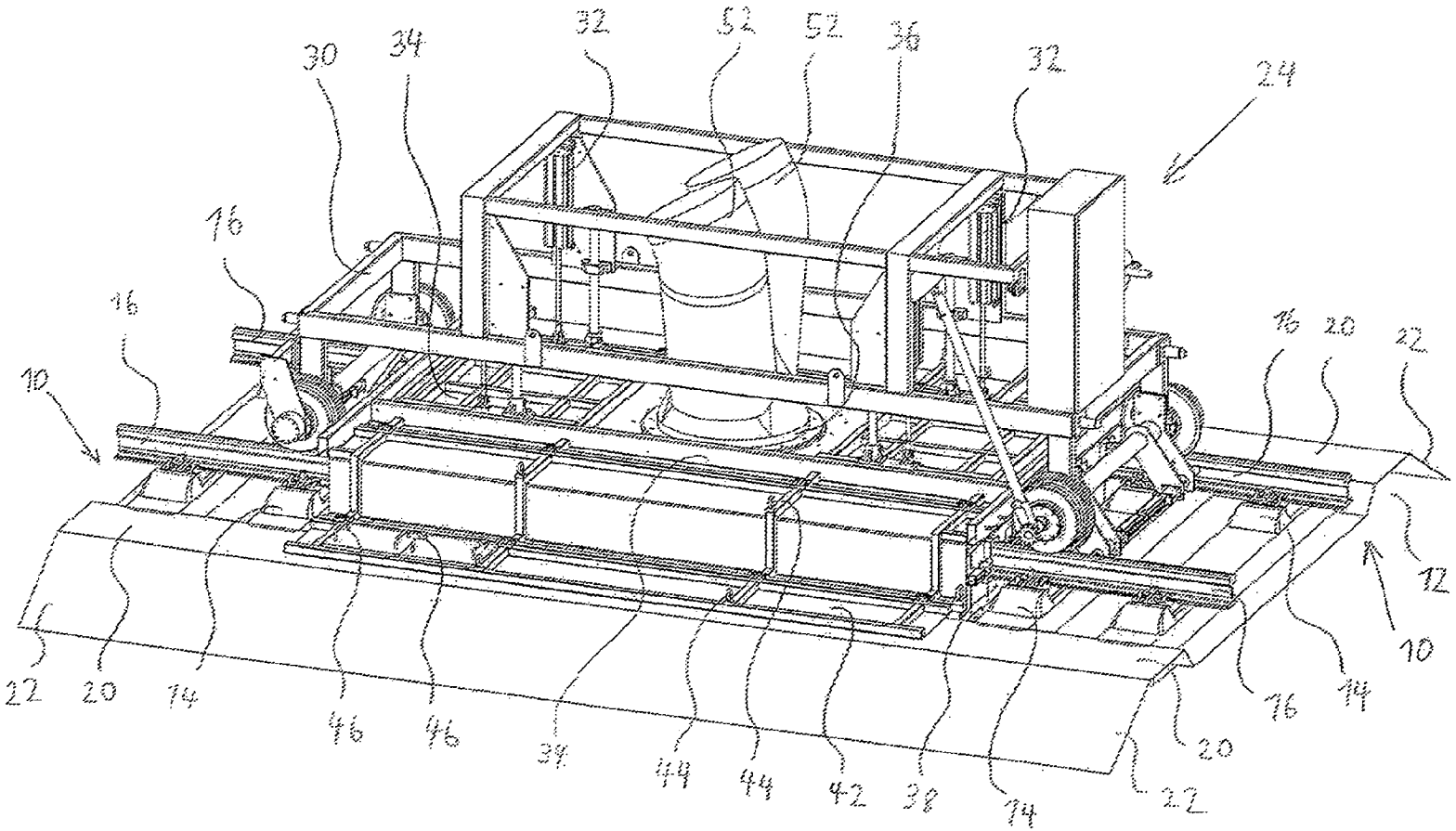

The invention is explained as an example below by way of a preferred exemplary embodiment with reference to the attached drawings, in which:

FIG. 1: shows a schematic top view of a railway track system,

FIG. 2: shows a schematic sectional view in the longitudinal direction of a conditioning device as claimed in the invention in a raised position, FIG. 3: shows a schematic sectional view in the transverse direction of the conditioning device from FIG. 2, FIG. 4: shows a schematic sectional view in the transverse direction of the conditioning device in FIG. 3 in a lowered position; and FIG. 5: shows a schematic perspective view of the conditioning device in FIG. 4.

The railway track system 10 shown in FIG. 1 has a ballast bed 12, on which several sleepers 14 rest. The sleepers 14 carry two rails 16 which are arranged spaced apart with respect to each other corresponding to the intended track width. The region between two sleepers 14 is referred to as a "sleeper compartment". The sleepers 14 lie in a carrying region 18 on the ballast bed 12. Next to the sleepers 14, the ballast bed 12 has a substantially horizontally aligned side strip 20. A sloping surface 22, which extends substantially inclinedly upward or in the majority of cases inclinedly downward, connects to the side strip 20. The conditioning device 24 shown in FIGS. 2 to 5 can blow temperature-controlled air in a blowing-in region 26 between the rails 16 in the exemplary embodiment shown beyond two sleeper compartments. The conditioning device 24 can prevent the temperature-controlled air from escaping from the ballast bed 12 in a cover region 28 around the blowing-in region 26.

As shown in FIG. 2, the conditioning device 24 has a bogie 30, to which a lifting device 32 is connected, which can move a hood 34 up and down. An outlet nozzle 36 is guided through the hood 34, by means of which temperature-controlled air can be blown by a blower into the blowing-in region 26. In addition in the exemplary embodiment shown, four separating-off devices 38, which extend transversely with respect to the direction of travel of the conditioning device 24, are connected to the hood 34. The separating-off devices 38 are displaceable in a pneumatic or hydraulic or electric manner in the direction of travel or in opposition to the direction of travel by means of displacement devices 40.

As shown in FIG. 3, a laterally protruding cover plate 42 is also connected to the hood 34. The cover plate 42 is connected to the hood 34 so as to be pivotable and can be pivoted from the operating position shown into a conveying position (not shown), in which the cover plate 42 can be locked via retaining rings 44 by means of locking pins or latch fasteners or tensioning cables. For pivoting the cover plate 42, the cover plate 42 can be provided with a handle 46. The separating-off device 38 has sealing-off plates 48 which are displaceable transversely with respect to the direction of travel and have a form-flexible sealing material 50 on their stop surfaces. The remaining sealing stop surfaces of the separating-off device 38 and of the cover plate 42 can also be provided with the form-flexible sealing material 50. The separating-off device 38 and the cover plate 42 are connected in their turn to the hood in a substantially air-tight manner.

In the lowered position of the conditioning device 24 shown in FIG. 4, the conditioning device 24 is sealed in an air-tight manner on the ballast bed 12, the sleepers 14 and the rails 16 by means of the sealing material 50 so as to be substantially air-tight. In particular, the side strip 20 is covered by the cover plate 42 such that the temperature-controlled air blown-in via the outlet nozzle 36 in the blowing-in region 26 is clearly only able to leave the ballast bed 12 at a spacing from the blowing-in region 26, for example via the sloping surface 22. On account of the high flow resistance on the surface of the ballast bed 12 and of the long flow path obtained as a result, the blown-in, temperature-controlled air is able to penetrate the ballast bed 12 in a particularly deep manner. In order to avoid the cover plates 42 lifting up as a result of the pending air pressure, the cover plates 42 can be made heavier, for example with separate weights.

As shown in FIG. 5, the hood 34, the cover plate 42 and the separating-off device 38 produce a bell which is sealed in a substantially air-tight manner in relation to the surrounding area, in which bell the blown-in, temperature-controlled air is able to collect and is able to build up correspondingly high pressure inside said bell, said pressure preventing temperature-controlled air which has penetrated into the track bed 12 from flowing out into the bell. In order to provide a correspondingly high volume flow, the outlet nozzle 36 can be connected to more than one inlet tube 52, each of which can be connected to a blower. In the exemplary embodiment shown, the outlet nozzle 36 is developed as a substantially rectangular tube which is guided through the hood 34.

The invention claimed is:

1. A conditioning device for drying and/or controlling the temperature of a ballast bed of a railway track system, wherein the railway track system has sleepers resting on the ballast bed and rails resting on the sleepers, said conditioning device comprising:

a bogie for moving the conditioning device, in particular on the rails;

an outlet nozzle, which is connected to the bogie, for blowing temperature-controlled air into the ballast bed via at least one blowing-in region positioned between two adjacent sleepers; and at least one cover plate, which is connected to the bogie, for the substantially air-tight covering of a top surface of a side strip of the ballast bed, said top surface pointing substantially in opposition to the direction of gravity and said side strip being provided next to the sleepers in the direction of travel.

2. The conditioning device as claimed in claim 1, characterized in that at least one sealing-off device for the substantially air-tight sealing of a sleeper and/or of a rail and/or of a top surface of a supporting strip of the ballast bed is connected to the bogie, said top surface pointing in opposition to the direction of gravity and said supporting strip being provided in front of or behind the sleeper in the direction of travel.

3. The conditioning device as claimed in claim 2, characterized in that the sealing-off device is designed in such a manner that the sealing-off device seals in a substantially air-tight manner at a sleeper which is spaced apart from a sleeper which borders the blowing-in region, wherein the sealing-off device seals in particular at a side surface of the sleeper which points in the direction of travel or in opposition to the direction of travel.

4. The conditioning device as claimed in claim 2, characterized in that the sealing-off device has at least one sealing-off plate which is movable transversely with respect to the direction of travel for the lateral substantially air-tight sealing of the rail and/or of the cover plate.

5. The conditioning device as claimed in claim 1, characterized in that a hood which is connected to the bogie is provided, wherein the hood is connected in particular in a substantially air-tight manner to the cover plate and/or to the sealing-off device.

6. The conditioning device as claimed in claim 1, characterized in that for the substantially air-tight sealing, the cover plate and/or the sealing-off device and/or the hood is provided with a form-flexible sealing material, wherein the sealing material has in particular an air cushion and/or brushes and/or rubber-like coatings and/or foam material, wherein the sealing material is covered in particular by an abrasion-resistant film and/or textile.

7. The conditioning device as claimed in claim 1, characterized in that at least two outlet nozzles are provided for blowing temperature-controlled air into the ballast bed via at least two blowing-in regions which are spaced apart with respect to each other, wherein the two blowing-in regions are preferably separated from each other in a substantially air-tight manner by means of a separating device, which is connected to the bogie and is designed in particular in a comparable manner to the sealing-off device.

8. The conditioning device as claimed in claim 1, characterized in that the outlet nozzle is designed in such a manner that the blowing-in region includes at least two sleeper compartments arranged between two sleepers.

9. The conditioning device as claimed in claim 1, characterized in that the cover plate is connected to the bogie so as to be pivotable between an operating position and a conveying position, wherein the extent of the conditioning device in the conveying position of the cover plate for conveying in a railway car is smaller than in the operating position of the cover plate.

10. A method for drying and controlling the temperature of a ballast bed of a railway track system, wherein the railway track system has sleepers resting on the ballast bed and rails resting on the sleepers, where in particular by means of a conditioning device as claimed in claim 1, a top surface of the ballast bed and/or at least one sleeper and/or at least one rail is sealed in a substantially air-tight manner outside a blowing-in region, before air, which is temperature-controlled, is blown into the ballast bed via the blowing-in region.

* * * * *